US006448844B1

(12) United States Patent
Cho

(10) Patent No.: US 6,448,844 B1
(45) Date of Patent: Sep. 10, 2002

(54) CMOS CONSTANT CURRENT REFERENCE CIRCUIT

(75) Inventor: Seong Ik Cho, Chollabuk-do (KR)

(73) Assignee: Hyundai Electronics Industries Co., Ltd., Kyoungki-do (KR)

( * ) Notice: Subject to any disclaimer, the term of this patent is extended or adjusted under 35 U.S.C. 154(b) by 0 days.

(21) Appl. No.: 09/722,386

(22) Filed: Nov. 28, 2000

(30) Foreign Application Priority Data

Nov. 30, 1999 (KR) ..... 99-53891

(51) Int. Cl.[7] ..... G05F 1/10
(52) U.S. Cl. ..... 327/538
(58) Field of Search ..... 323/312, 313, 323/314, 315, 316; 327/143, 378, 530, 534, 535, 537, 538, 540, 541, 543, 545, 546

(56) References Cited

U.S. PATENT DOCUMENTS 4,835,487 A * 5/1989 Doyle et al. ..... 323/315
5,034,626 A * 7/1991 Pirez et al. ..... 323/315
5,081,380 A * 1/1992 Chen ..... 323/312
5,180,967 A * 1/1993 Yamazaki ..... 323/312
5,349,286 A * 9/1994 Marshall et al. ..... 323/313
5,563,502 A * 10/1996 Akioka et al. ..... 323/313
5,783,936 A * 7/1998 Girard et al. ..... 323/315
5,818,294 A * 10/1998 Ashmore, Jr. ..... 323/315
5,859,560 A * 1/1999 Matthews ..... 323/312
5,939,933 A * 8/1999 Wang ..... 327/512
5,955,874 A * 9/1999 Zhou et al. ..... 323/315
6,107,868 A * 8/2000 Diniz et al. ..... 327/512

* cited by examiner

*Primary Examiner*—Jeffrey Zweizig
(74) *Attorney, Agent, or Firm*—Pillsbury Winthrop LLP

(57) ABSTRACT

Disclosed is a CMOS constant current reference circuit having a circuit configuration that includes transistors only of the COMS type and not including any bipolar transistors. The circuit is capable of providing a constant current to a load, regardless of a variation in supply voltage and a variation in temperature. A constant current generating unit generates a constant bias current regardless of a variation of a supply voltage. A self compensation unit controls the constant current generating means to maintain the bias current generated therefrom at a constant level regardless of a variation in temperature. A starting unit establishes a current path adapted to activate the constant current generating unit. A constant current supply unit supplies the bias current generated from the constant current generating unit, at a constant level.

10 Claims, 2 Drawing Sheets

CM OS CONSTANT CURRENT REFERENCE CIRCUIT

BACKGROUND OF THE INVENTION

1. Field of the Invention

The present invention relates in general to a CMOS constant current reference circuit suitable for use with a Rambus DRAM. More specifically, the invention relates to a CMOS constant current reference circuit capable of providing a constant current to a load, regardless of a variation in supply voltage and a variation in temperature.

2. Description of the Related Art

FIG. 1 (Prior Art) is a conventional constant current reference circuit using a CMOS transistor and a bipolar transistor. The conventional constant current reference circuit includes a negative current generating unit 10 for generating a first current $I_1$ having a negative (−) coefficient, a first positive current generating unit 20 for generating a second current $I_2$ having a positive (+) coefficient, a second positive current generating unit 30 for generating a third current $I_3$ having a positive (+) coefficient, and a current summing circuit 40 for summing together the first current $I_1$, having a negative (−) coefficient and the second current $I_2$ having a positive (+) coefficient, thereby generating a constant bias current $I_{bias}$.

The negative current generating unit 10 includes a PMOS transistor MP3 adapted to transmit a supply voltage $V_{DD}$ to a node Nd1 in response to a signal from the node Nd1, and an NMOS transistor MN3 adapted to supply the signal from the node Nd1 to a resistor R1 coupled to a ground voltage Vss in response to a signal from a node Nd3.

The first positive current generating unit 20 includes a PMOS transistor MP2 adapted to supply the supply voltage $V_{DD}$ to a node Nd2 in response to a signal from the node Nd2. The first positive current generating unit 20 also includes an NMOS transistor MN2, a resistor R2, and a PNP type bipolar transistor Q1 connected in series between the node Nd2 and the ground voltage Vss. The NMOS transistor MN2 serves to supply the signal from the node Nd2 to the resistor R2 in response to the signal from the Nd3. The PNP type bipolar transistor Q1 is coupled at the base thereof to the ground voltage Vss, so that it is always in an ON state thereof.

The second positive current generating unit 30 includes a PMOS transistor MP1 adapted to supply the supply voltage $V_{DD}$ to the node Nd3 in response to the signal from the node Nd2. The second positive current generating unit 30 also includes an NMOS transistor MN1 and a PNP type bipolar transistor Q2 connected in series between the node Nd3 and the ground voltage Vss. The NMOS transistor MN1 serves to supply the signal from the Nd3 to the emitter of the PNP type bipolar transistor Q2 in response to the signal from the node Nd3. The PNP type bipolar transistor Q2 is coupled at the base thereof to the ground voltage Vss, so that it is always in an ON state.

The current summing circuit unit 40 includes a PMOS transistor MP4 adapted to supply the supply voltage $V_{DD}$ to a node Nd4 in response to the signal from the node Nd1, a PMOS transistor MP5 adapted to supply the supply voltage $V_{DD}$ to the node Nd4 in response to the signal from the node Nd2, and an NMOS transistor MN4 adapted to discharge a voltage from the node Nd4 in response to a bias current $I_{bias}$ applied to the node Nd4. The bias current $I_{bias}$ flowing through the node Nd4 has a constant value corresponding to the sum of a current $I_1$, having a negative (−) coefficient, supplied through the PMOS transistor MP4 and a current $I_2$, having a positive (+) coefficient, supplied through the PMOS transistor MP5.

Now, the operation of the conventional constant current reference circuit having the above mentioned configuration will be described. For the current $I_2$ flowing through the resistor R2 in a loop including the PNP type bipolar transistor Q1, resistor R2, NMOS transistors MN2 and MN1, and PNP type bipolar transistor Q2, the following equations apply:

$$V_{BE2}=I_2\times R_2+V_{BE1}$$

$$I_2=(V_{BE2}-V_{BE1})/R_2$$

Hence, $$V_{BE2}=(kT/q)\ln(I_2/I_3),\ V_{BE1}=(kT/q)\ln(I_1/I_3)$$
$$\Rightarrow I_2=(kT/qR_2)\ln(I_2/I_1)$$

In the above equations, "$V_{BE2}$" represents a voltage applied across the PNP type bipolar transistor Q2 between the emitter and base thereof, and "kT/q" represents a thermal voltage $V_T$ depending on a temperature coefficient TC ($V_T$=kT/q), where "k" is Boltzmann's constant, "T" is the absolute temperature in Kelvin and "q" is the magnitude of the electronic charge.

Accordingly, the current source of the current $I_2$, which has a positive (+) coefficient, can be derived, based on a temperature. The current $I_2$ is mirrored to the PMOS transistor MP5 by the PMOS transistor MP2. For the current $I_1$ flowing through the resistor R1 in a loop including the NMOS transistors MN3 and MN1, and PNP type bipolar transistor Q2, the following equations apply:

$$V_{BE2}=I_1\times R_1$$

$$I_1=V_{BE2}/R_1$$
$$\Rightarrow I_1=(kT/qR_1)\ln(I_2/I_3)$$

Accordingly, the current source of the current $I_1$, which has a negative (−) coefficient, can be derived, based on a temperature. The current $I_1$ is mirrored to the PMOS transistor MP4 by the PMOS transistor MP3.

The current summing circuit, which consists of the PMOS transistors MP4 and MP5, and the NMOS transistor MN4, generates a constant bias current $I_{bias}$ by summing together the mirrored current $I_1$ having a negative (−) coefficient and the mirrored current $I_2$ having a positive (+) coefficient.

This bias current $I_{bias}$ can be expressed as follows:

$$I_{bias}=I_1+I_2=(V_{BE2}/R_1)+(\Delta V_{BE}/R_2)$$

$$\Delta V_{BE}=V_{BE2}-V_{BE1}$$

However, the above mentioned conventional constant current reference circuit, which uses the bipolar transistors Q1 and Q2 respectively adapted to generate currents having positive (+) and negative (−) coefficients depending on an increase in temperature, has a problem in that when a negative (−) current source is formed depending on an increase in temperature, by use of the bipolar transistors Q1 and Q2, it is necessary to extract model parameters by individually forming respective patterns of the bipolar transistors Q1 and Q2 in the manufacture of MOS transistors. Furthermore, the integration of the constant current reference circuit into a chip is uneconomical because the constant current reference circuit occupies a chip area considerably larger than that of the MOS transistors. Where the constant current reference circuit is used to generate a voltage reference, an increased variation in voltage is exhibited due to an increased variation in current resulting from a high temperature coefficient. For this reason, there is a problem in that a degradation in output occurs in the case of a system requiring a precise output.

The conventional constant current reference circuit has a problem in that it requires a number of transistors because it should have not only the circuits for generating the negative (−) current $I_1$ and the positive (+) current $I_2$, respectively, but also the circuit for generating the constant bias current based on the sum of the currents $I_1$ and $I_2$ having respective positive (+) and negative (−) coefficients.

SUMMARY OF THE INVENTION

According to one aspect of the invention, there is provided a CMOS constant current reference circuit having a simple circuit configuration, wherein the only transistors are CMOS transistors. There are no bipolar transistors. The circuit configuration is capable of providing a constant current to a load, regardless of a variation in supply voltage and a variation in temperature.

A constant current generating means generates a constant bias current regardless of a variation of a supply voltage. A self compensation means controls the bias current generating means to maintain the bias current generated therefrom at a constant level regardless of a variation in temperature. A starting means establishes a current path adapted to activate the constant current generating means. A constant current supply means supplies the bias current generated from the constant current generating means, in a constant amount.

The constant current generating means comprises a first PMOS transistor and a second PMOS transistor respectively adapted to supply the supply voltage to a first node and a second node at constant levels in accordance with a voltage level at the second node, and a first NMOS transistor and a second NMOS transistor respectively adapted to discharge voltages from the first and second nodes into a ground voltage, the first and second PMOS transistors being a current mirror structure and the first and second NMOS transistors being a current mirror structure.

The constant current generating means further comprises a variable resistor coupled between the second NMOS transistor and the ground voltage and adapted to control a parameter depending on a process variation. The self compensation means comprises a PMOS transistor coupled between the first node and the ground voltage while having a diode structure. The starting means comprises an NMOS transistor coupled between the supply voltage and the first node while having a diode structure. The constant current supply means comprises NMOS transistors being a current mirror structure.

BRIEF DESCRIPTION OF THE DRAWINGS

The claimed inventions will be described in greater detail with reference to the drawings, in which:

DETAILED DESCRIPTION

Figure 1:
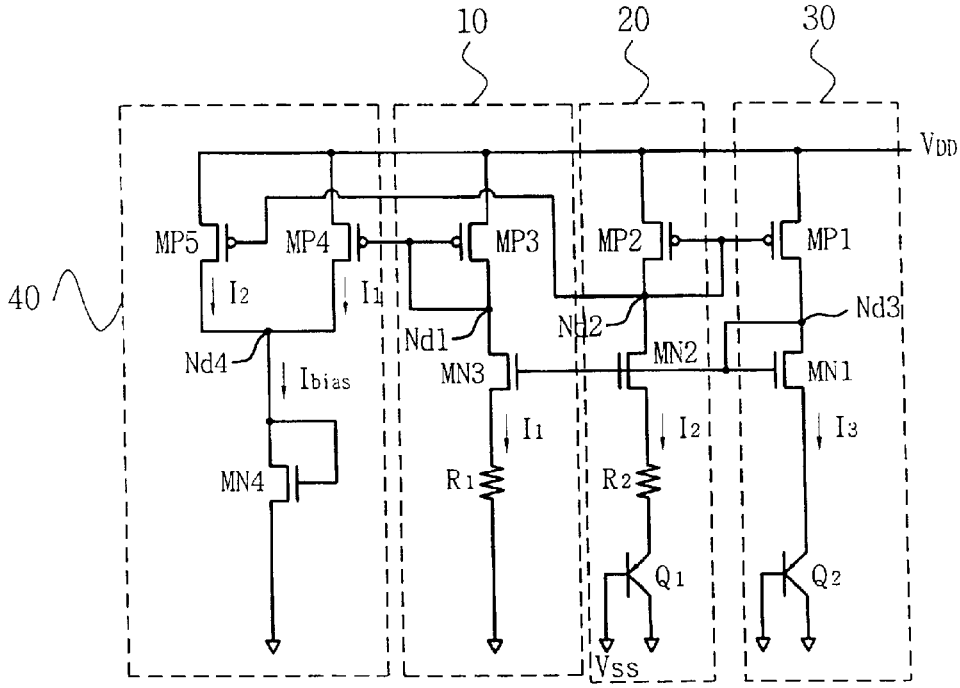
FIG. 1 (Prior Art)
FIG. 1 (Prior Art) is a conventional constant current reference circuit using a CMOS transistor and a bipolar transistor.

Now, the present invention will be described in detail, in conjunction with the drawings. In the drawings, elements having the same function are denoted by the same reference numeral, and no repeated description will be made for those elements.

Figure 2:
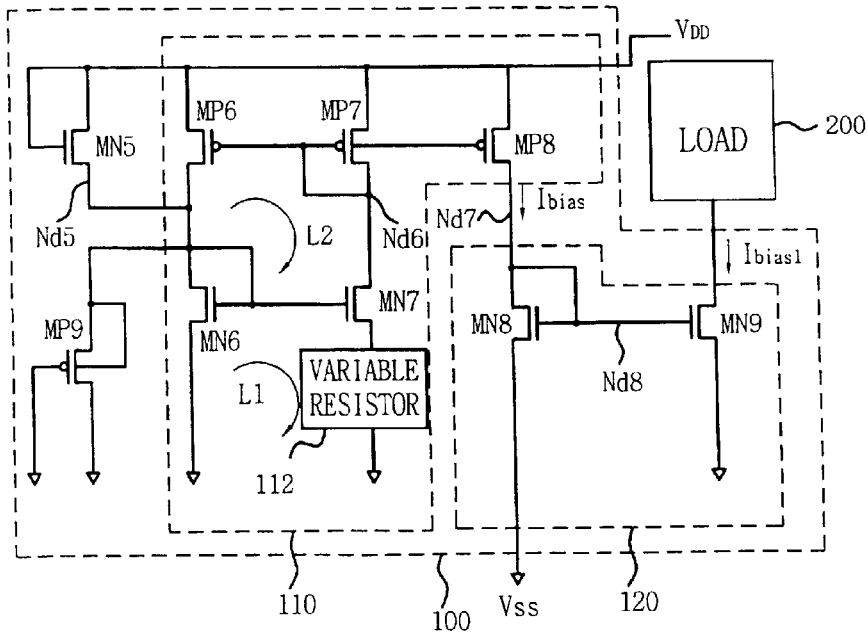
FIG. 2 is a circuit diagram of a CMOS constant current reference circuit according to the present invention.

FIG. 2 is a circuit diagram of a CMOS constant current reference circuit according to the present invention. The CMOS constant current reference circuit 100 includes a constant current generating unit 110 for generating a constant bias current $I_{bias}$ regardless of a variation of a supply voltage $V_{DD}$, and a self compensation unit MP9 for controlling the constant current generating unit 110 to maintain the bias current generated therefrom at a constant level regardless of a variation in temperature. The CMOS constant current reference circuit also includes a starting circuit unit MN5 for establishing a current path adapted to activate the constant current generating unit 110, and a constant current outputting unit 120 for supplying the bias current $I_{bias}$ generated from the constant current generating unit 110, in a constant level.

The constant current generating unit 110 includes PMOS transistors MP6 and MP7 respectively adapted to supply the supply voltage $V_{DD}$ to nodes Nd5 and Nd6, at constant levels, in accordance with a voltage level at the node Nd6, the first and second PMOS transistors being a current mirror structure. The PMOS transistors MP6 and MP7 has a current mirror structure. The constant current generating unit 110 also includes NMOS transistors MN6 and MN7 respectively adapted to drop voltage levels at the nodes Nd5 and Nd6 to a ground voltage Vss, in accordance with a voltage level at the node Nd5. The NMOS transistors MN6 and MN7 being a current mirror structure.

Figure 3:
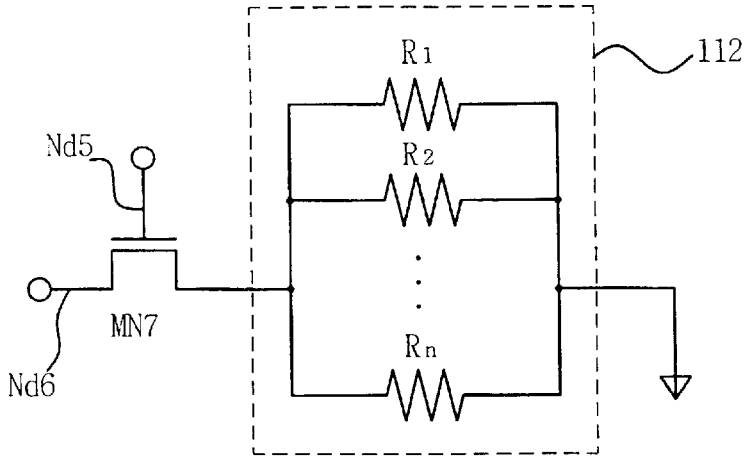
FIG. 3 is a circuit diagram of the configuration of a variable resistor, included in a constant current generating unit shown in FIG. 2, in accordance with an embodiment of the present invention.

A variable resistor 112 is coupled between the drain of the NMOS transistor MN7 and the ground voltage Vss. In order to prevent the output bias voltage $I_{bias}$ from varying due to a process variation, the variable resistor 112 comprises a plurality of parallel resistors R1,R2, . . . ,Rn adapted to adjust the resistance value depending on a process variation, as shown in FIG. 3.

The constant current generating unit 110 having the above mentioned configuration establishes a self loop including the PMOS transistors MP6 and MP7, and the NMOS transistors MN6 and MN7. Accordingly, the circuit does not operate unless a current path is established. To this end, the starting circuit unit MN5 comprises a diode type NMOS transistor so as to supply the supply voltage $V_{DD}$ to the node Nd5 of the constant current generating unit 110.

When the supply voltage $V_{DD}$ is supplied to the node Nd5 in accordance with an operation of the starting circuit unit MN5, the current mirror type NMOS transistors MN6 and MN7, serving as current sources, turn on, thereby operating the circuit. At this time, the potential at the node Nd6 is relatively lower than that at the node Nd5. As a result, the PMOS transistors MP6, MP7, and MP8, each of which uses the signal from the Nd6 as a gate input thereof, are rendered to turn on. The MOS transistors MP6, MP7, and MP8 supply constant currents to the nodes Nd5, Nd6, and Nd7 at ON states thereof, respectively.

By virtue of such a configuration, the constant current generating unit 110 generates a bias current $I_{bias}$ in a constant amount even when the supply voltage $V_{DD}$ varies in level.

That is, when the supply voltage $V_{DD}$ is high, respective resistances of the NMOS transistors MN6 and MN7 are increased, so that they supply an increased amount of current to the ground voltage Vss. Meanwhile, the PMOS transistors MP6, MP7, and MP8 exhibit reduced resistances by virtue of the potential of the node Nd6 relatively higher than that of the node Nd5. Thus, respective amounts of current supplied to the nodes Nd5, Nd6, and Nd7 are controlled. Accordingly, where the supply voltage $V_{DD}$ is high, the bias current $I_{bias}$ flowing through the node Nd7 is controlled by the PMOS transistor MP8 so that it is constant.

When the supply voltage $V_{DD}$ has a reduced level, the potential of the node Nd5 is correspondingly reduced, thereby causing the NMOS transistors MN6 and MN7 to exhibit reduced resistances, respectively. As a result, respective amounts of current flowing to the ground voltage Vss through the NMOS transistors MN6 and MN7 is correspondingly reduced. However, the PMOS transistors MP6 and MP7 exhibit increased resistances by virtue of the potential of the node Nd6 relatively lower than that of the node Nd5. Accordingly, the bias current $I_{bias}$ flowing through the node Nd7 is constant in spite of the fact that the supply voltage $V_{DD}$ is reduced.

Although the constant current generating unit 110 outputs a constant bias current regardless of a variation in the supply voltage $V_{DD}$, it cannot compensate for a current variation resulting from a temperature variation.

In order to output a constant bias current $I_{bia}$, regardless of a temperature variation, the self compensation circuit unit MP9 is coupled between the node Nd5 of the constant current generating unit 110 and the ground voltage Vss. The self compensation circuit unit MP9 comprises a PMOS transistor coupled between the node Nd5 and the ground voltage Vss while being connected at the gate thereof to the ground voltage Vss.

Figure 4:
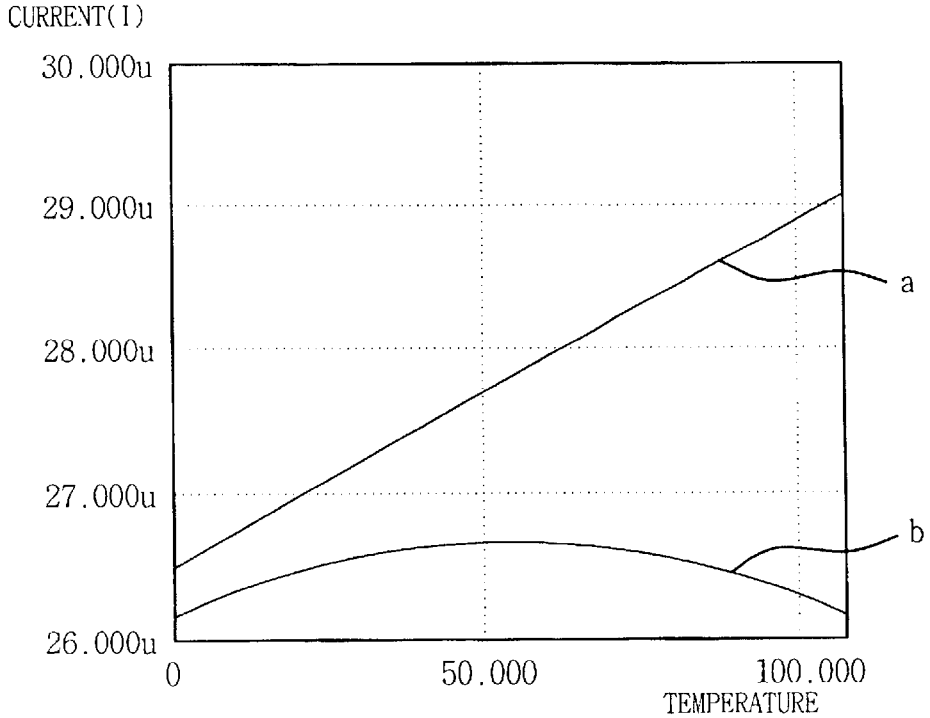
FIG. 4 is a graph depicting respective output waveforms of a bias current depending on a temperature variation in the case, in which a self compensation circuit unit shown in FIG. 2 is not used, (the curve "a"), and the case in which the self compensation circuit unit is used (the curve "b").

FIG. 4 is a graph depicting respective output waveforms of the bias current $I_{bias}$ depending on a temperature variation in the case, in which the self compensation circuit unit MP9 shown in FIG. 2 is not used, (the curve "a"), and the case in which the self compensation circuit unit MP9 is used (the curve "b").

In FIG. 4, the curve "a" depicts the waveform of the output bias current generated where the self compensation circuit unit MP9 is not used. Referring to the curve "a", it can be found that the amount of current is increased as an increase of temperature. On the other hand, the curve "b" depicts the waveform of the output bias current generated where the self compensation circuit unit MP9 is used. Referring to the curve "b", it can be found that a substantially constant current is generated regardless of a temperature variation.

Since the above mentioned self compensation circuit unit MP9 is provided, the constant current generating unit 110 can generate a bias current $I_{bias}$ of a constant amount, as a constant current source, regardless of a variation in the supply voltage $V_{DD}$ and a variation in temperature.

The constant current outputting unit 120 serves to supply the constant current $I_{bias}$ generated from the constant current generating unit 110 to the load 200. This constant current outputting unit 120 includes an NMOS transistor MN9 adapted to supply a constant current source $I_{bias1}$, to the load 200, and an NMOS transistor MN8, the NMOS transistors MN8 and MN9 being a current mirror structure.

By the current-mirrored NMOS transistors MN8 and MN9, the constant current outputting unit 120 supplies the constant bias current $I_{bias1}$, to the load 200, based on the constant current source $I_{bias}$ received from the constant current generating unit 110.

As apparent from the above description, the CMOS constant current reference circuit of the present invention is configured to provide a constant current to a load regardless of a variation in supply voltage and a variation in temperature, only using COMS transistors without using any bipolar transistor. Accordingly, it is possible to achieve a reduction in chip area, as compared to conventional cases using bipolar transistors.

Where a negative (−) current source depending on an increase in temperature is formed by use of bipolar transistors, it is necessary to extract model parameters by individually forming respective patterns of the bipolar transistors in the manufacture of MOS transistors. However, where such a negative (−) current source is formed only using MOS transistors, there is an advantage in that it is possible to form a precise current reference circuit, as a reference circuit, because accurate model parameters are secured. Accordingly, it is unnecessary for the designer to experience a number of trials and errors. Thus, a reduction in designing time is achieved.

All known devices are fabricated in the form of an on-chip structure, using a CMOS process. In this connection, the CMOS constant current reference circuit, consisting of MOS transistors, realized in accordance with the present invention can be applied to any types of devices, such as analog circuits and memory circuits, requiring use of a bias voltage, after the designer is simply set a reference voltage. Where the circuit of the present invention is integrated in the chip of a system, it provides a variety of advantages in terms of low voltage, compatibility, occupying area, and costs, as compared to conventional structures using bipolar transistors.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A CMOS constant current reference circuit, comprising:

constant current generating means for generating a constant bias current regardless of a variation of a supply voltage applied thereto;

self compensation means for controlling the constant current generating means to maintain the bias current generated therefrom at a constant level regardless of a variation in temperature;

starting means for establishing a current path adapted to activate said constant current generating means; and constant current supply means for supplying the bias current generated from said constant current generating means, in a constant level, wherein the self compensation means comprises a PMOS transistor which has a bulk coupled to a first node of the constant current generating means, a source coupled to the first node, a gate coupled to ground, and a drain to the ground.

2. A circuit according to claim 1, wherein the constant current generating means comprises:

a first PMOS transistor and a second PMOS transistor respectively adapted to supply the supply voltage to the first node and a second node at substantially constant levels in accordance with a voltage level at the second node, the first and second PMOS transistors being configured as a current mirror; and a first NMOS transistor and a second NMOS transistor respectively adapted to drop voltage levels at the first and second nodes to a ground voltage level in accordance with a voltage level at the first node, the first and second node NMOS transistors being configured as a current mirror.

3. The circuit according to claim 2, wherein the constant current generating means further comprises:

a variable resistor coupled between the second NMOS transistor and the ground voltage.

4. The CMOS constant current reference circuit according to claim 2, wherein the starting means comprises an NMOS transistor coupled between the supply voltage and the first node, the NMOS transistor being a diode structure.

5. The CMOS constant current reference circuit according to claim 1, wherein the constant current supply means comprises NMOS transistors arranged as a current mirror.

6. A CMOS constant current reference circuit, comprising:

a constant current generating circuit arrangement (CCGCA) for generating a constant bias current regardless of a variation of a supply voltage applied thereto;

a self compensation circuit arrangement for controlling the CCGCA to maintain the bias current generated therefrom at a constant level regardless of a variation in temperature;

a starting circuit arrangement capable of establishing a current path that can activate the CCGCA; and a constant current supply circuit capable of supplying the bias current generated from the CCGCA, in a constant level, wherein the self compensation circuit arrangement comprises a PMOS transistor which has a bulk coupled to a first node of the CCGCA, a source coupled to the first node, a gate coupled to ground, and a drain to the ground.

7. A circuit according to claim 6, wherein the CCGCA comprises:

a first PMOS transistor and a second PMOS transistor respectively adapted to supply the supply voltage to the first node and a second node at substantially constant levels in accordance with a voltage level at the second node, the first and second PMOS transistors being configured as a current mirror; and a first NMOS transistor and a second NMOS transistor respectively adapted to drop voltage levels at the first and second nodes to a ground voltage level in accordance with a voltage level at the first node, the first and second node NMOS transistors being configured as a current mirror.

8. The circuit according to claim 7, wherein the CCGCA further comprises:

a variable resistor coupled between the second NMOS transistor and the ground voltage.

9. The CMOS constant current reference circuit according to claim 7, wherein the starting circuit arrangement comprises an NMOS transistor coupled between the supply voltage and the first node, the NMOS transistor being a diode structure.

10. The CMOS constant current reference circuit according to claim 6, wherein the constant current supply circuit comprises NMOS transistors arranged as a current mirror.

* * * * *